US005086570A

United States Patent [19]

Matheus

[11] Patent Number: 5,086,570

[45] Date of Patent: Feb. 11, 1992

[54] DRYING APPARATUS FOR SCREEN PROCESS PRINTING AND COATING

[75] Inventor: Frank J. Matheus, Mission Viejo, Calif.

[73] Assignee: Screen Printing Enterprises, Inc., Huntington Beach, Calif.

[21] Appl. No.: 589,976

[22] Filed: Sep. 28, 1990

[51] Int. Cl.[5] ..... F26B 3/34

[52] U.S. Cl. ..... 34/1 L; 34/60

[58] Field of Search ..... 34/41, 155, 156, 18, 34/60, 62, 68, 1, 4, 72

[56] References Cited

U.S. PATENT DOCUMENTS 4,296,555 10/1981 Preston ..... 34/1
4,359,826 11/1982 Rounsley ..... 34/18
4,501,072 2/1985 Jacobi, Jr. et al. ..... 34/1

*Primary Examiner*—Henry A. Bennett
*Assistant Examiner*—Denise L. F. Gromada
*Attorney, Agent, or Firm*—Leonard Tachner

[57] ABSTRACT

An improved drying apparatus for screen process printing and coating, using water-based inks and coatings, whereby a novel combination of a forced hot air dryer and radio frequency dryer is provided. The principal advantages of the present invention as compared to the prior art reside in the significant savings in floor space requirements and power requirements for high produciton (i.e., 2,000–3,000 impression per hour) screen process printing and coating operations which have heretofore utilized a 40 foot length hot air drying apparatus which suffers from a number of disadvantages as previously described. The RF dryer and hot air dryer portions of the present invention are serially arranged on a common conveyer belt apparatus and may be combined with an optional air conditioning cooler which is positioned on the output side of the radio frequency dryer for cooling the cured ink or coating material as it exits from the radio frequency dryer. The radio frequency dryer portion of the preferred embodiment of the present invention, operates at about 27 MHz. generating at least 12 kilowatts of radio frequency output power on an input power of 22 kilowatts maximum. The hot air dryer used with the present invention, because of the significant amount of drying induced by the radio frequency dryer thereof, may be substantially smaller and operate at a substantially lower temperature than the conventional hot air dryer used in the prior art and which provides the entire curing effect of such prior art systems.

6 Claims, 5 Drawing Sheets

DRYING APPARATUS FOR SCREEN PROCESS PRINTING AND COATING

BACKGROUND OF THE INVENTION

1. Field of the Invention

The present invention relates generally to the screen process printing and coating industry and more specifically to an improved drying apparatus which provides for minimum energy and floor space requirements in high volume screen process printing and coating operations by uniquely combining hot air and radio frequency drying in a sequential conveyer belt arrangement.

2. Prior Art

The recent increase in ecological and work safety concerns has motivated the increased use of water-based inks and coatings in the screen process printing industry. Although the drying or curing of such water-based inks and coatings may be carried out at ambient temperatures at relatively high production volume, such as 2,000 to 3,000 impressions per hour, the storage space requirements to permit an adequate opportunity for 100% curing are prohibitive because each such sheet must be fully dried before it can be stacked. Stacking before a 100% cure has been achieved can lead to offset interblocking wherein the incompletely cured ink or coating on sheet attaches to the next sheet in such stacking, particularly where such stacking is done in significant numbers, such as in high volume production stacking. One prior art technique for accelerating the curing time for water-based screen process coatings and inks has been the use of high velocity jet dryers which typically propel hot air, such as air at 200 to 250 degrees Fahrenheit, at the coated or printed sheets as they leave the coating apparatus. Unfortunately, in high volume screen process coating or printing production lines, employing 2,000 to 3,000 impressions per hour, it is typically necessary to provide up to 40 feet of such high velocity jet dryer apparatus and an additional 20 feet or more of cooling apparatus in order to attain the degree of curing necessary to avoid the aforementioned offset interblocking during stacking. Accordingly, a great deal of floor space is required to provide the necessary amount of high velocity jet drying action. Furthermore, this floor space problem is further exacerbated by the need to provide large cooling systems which typically must occupy 15–20 feet of floor space in order to offset the affect of the high velocity jet dryer wherein the extremely hot air has heated not only the coating, but also the underlying sheet material. Still another disadvantage of the exclusive use of large high velocity jet dryers for drying water-based coatings is the extremely high energy requirements of such jet dryers. For example, in a typical prior art application where a 40 foot long high velocity jet dryer producing high velocity air at approximately 250 degrees Fahrenheit is utilized, energy requirements would be on the order of 100–120 kilowatts. Furthermore, the total floor space requirement for such inefficient hot air drying would be on the order of 100 linear feet.

It will be seen hereinafter that the present invention utilizes a novel combination of a significantly reduced amount of hot air drying and a radio frequency (RF) dryer, to significantly reduce both the power requirement and the floor space requirement for drying water-based screen process printing or coating applications. The use of RF drying is not novel for removing water from materials in manufacturing processes. RF drying for example, has been used in the food processing industry to extract moisture from food products without damaging such products. It has also been used in the stationary industry, for example, to adhere glue on envelopes, stamps and the like. However, it is believed to be an entirely novel and unique application of RF drying to the screen process printing industry, particularly in combination with a significantly reduced amount of hot air drying which precedes the RF drying for purposes of accelerating the curing prior to the RF drying stage. Consequently, until the present invention described herein, there has been an ongoing need for a more efficient method for drying water-based screen processing materials and particularly for curing the coatings and inks thereon, in order to provide a system which can generate a 100% cured high volume production screen printing process in volumes of at least 2,000 impressions per hour while significantly reducing the amount of floor space and the energy requirement for such production.

SUMMARY OF THE INVENTION

The present invention provides a solution to the aforementioned need by significantly reducing both the power requirement and floor space requirement for high-volume screen printing process applications for drying water-based inks and coatings. More specifically, the present invention provides a unique combination of a radio frequency drying apparatus and a reduced size hot air drying apparatus operating in sequence whereby the floor space required, as compared to the aforementioned prior art, is reduced by approximately 60% and the power requirement is reduced by 50–65% of the prior art requirements for drying exclusively with high velocity heated air. In the preferred embodiment of the invention disclosed herein, the air dryer used is a four foot section dryer which provides approximately 3,000 cubic feet per minute of air heated to 150 degrees Fahrenheit using approximately 18 kilowatts of energy and about 5 linear feet of overall floor space to initiate the curing or drying sequence of the present invention. The radio frequency dryer of the present invention is approximately 8 feet in overall length and includes 6½ feet of radio frequency grid elements which produce at least 12 kilowatts of radio frequency power output at about 27 MHz. A one foot gap is provided between the hot air apparatus and the radio frequency apparatus of the present invention. Accordingly, measured linearly, the total length of the combination of hot air and radio frequency drying apparatus of the present invention comprises a length of about 14½ feet as compared to about 40 feet for a comparable hot air jet dryer of the prior art. Furthermore, the total input power required for drying in accordance with the present invention is approximately 40 kilowatts, as compared to about 100–120 kilowatts using the elongated hot air dryer exclusively, as is conventional in the prior art. An optional 4 foot long air conditions cooler may be provided and is shown herein in a preferred embodiment of the invention. However, it will be understood that comparable cooling would also be required in the prior art system. In fact, the cooling requirements of the prior art system are significantly higher because of the significant amount of heat that must be removed from the material that is coated or printed in the prior art system.

OBJECTS OF THE INVENTION

It is therefore a principal object of the present invention to provide an improved drying apparatus for use in screen process printing for curing water-based inks and coatings in a significantly more efficient manner from the standpoint of both floor space and energy requirements.

It is an additional object of the present invention to provide a novel combination of hot air and radio frequency drying for use in the screen process printing industry for curing water-based inks and coatings in a high production facility such as where at least 2,000 impressions per hour are passed through the drying apparatus.

It is still an additional object of the present invention to significantly reduce the floor space and energy requirements for a drying apparatus in high volume production of screen process coated or printed impressions which utilize water-based coatings and inks, said reduction being attained by the use of a novel combination of a radio frequency dryer and a hot air jet dryer.

BRIEF DESCRIPTION OF THE DRAWINGS

The aforementioned objects and advantages of the present invention, as well as additional objects and advantages thereof will be more fully understood hereinafter as a result of a detailed description when taken in conjunction with the following drawings in which.

DETAILED DESCRIPTION OF A PREFERRED EMBODIMENT

Figure 1:
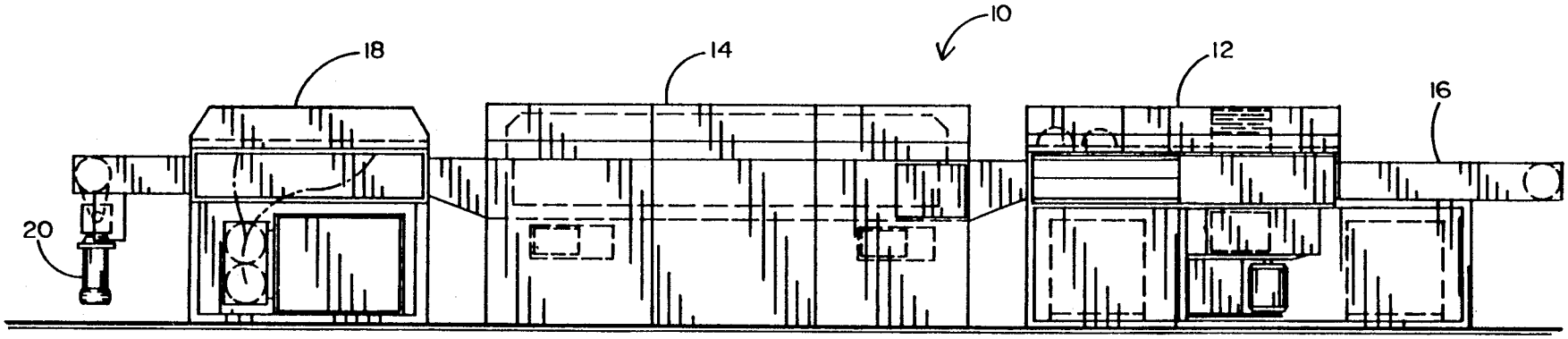
FIG. 1 is an elevational view of the drying apparatus of the present invention.
Figure 2:
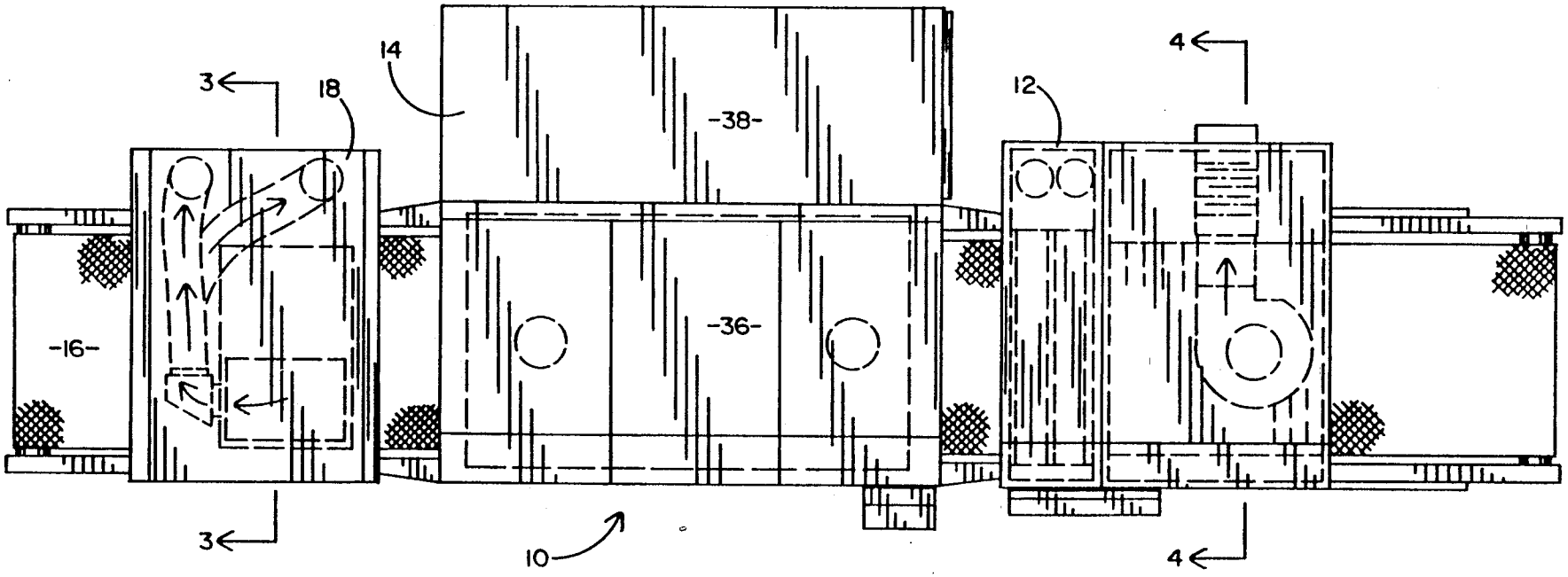
FIG. 2 is a top view of the drying apparatus of the present invention.

Referring now to FIGS. 1 and 2, it will be seen that the improved drying apparatus 10 of the present invention, comprises a hot air dryer 12 and a radio frequency dryer 14 interconnected by a conveyer belt 16. Also shown therein, is an optional air conditioning cooler 18, which is positioned on the output side of the radio frequency dryer 14, and is also interconnected thereto by means of conveyer belt 16. A conveyer belt drive motor 20 is also provided to place the conveyer belt in motion.

Figure 4:
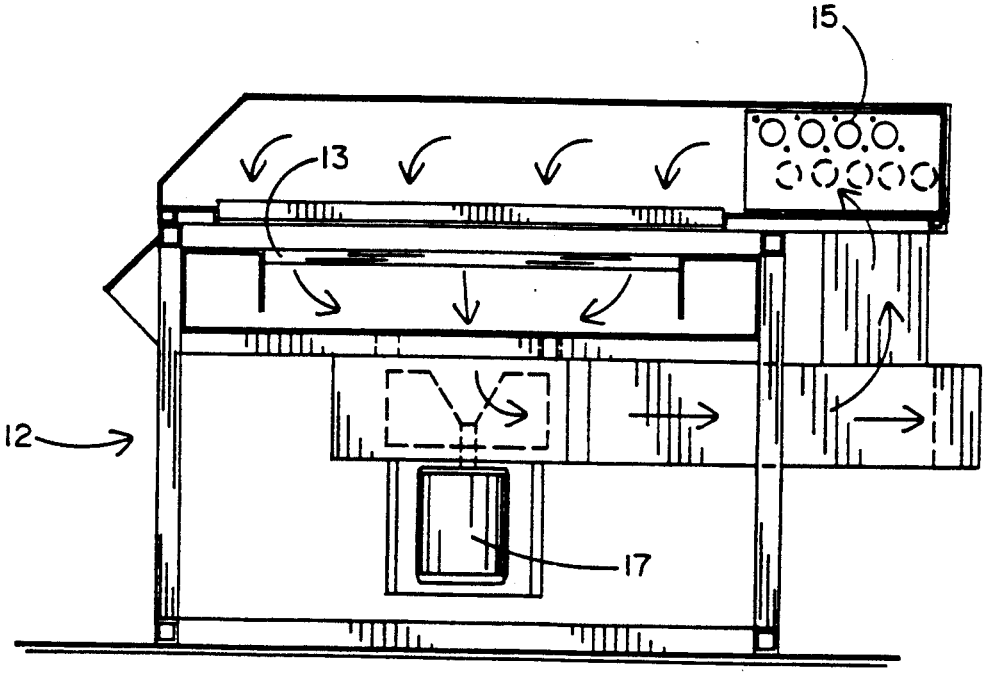
FIG. 4 is a sectional view of the hot air dryer portion of the present invention taken along lines 4—4 of FIG. 2.

In the preferred embodiment of the invention shown herein, the hot air dryer 12 is 5⅓ in length along the conveyer belt 16 and provides a 4 foot section of air flow through a plurality of extruded air knives 13, seen best in FIG. 4. The air is heated to a temperature of about 150 degrees Fahrenheit by a plurality of 2,000 watt heating elements 15 through which air expelled by a blower 17 is passed before reaching the air knives. The air flow in the hot air dryer 12 shown herein, provides an air flow rate of 3,000 cubic feet per minute.

Figure 3:
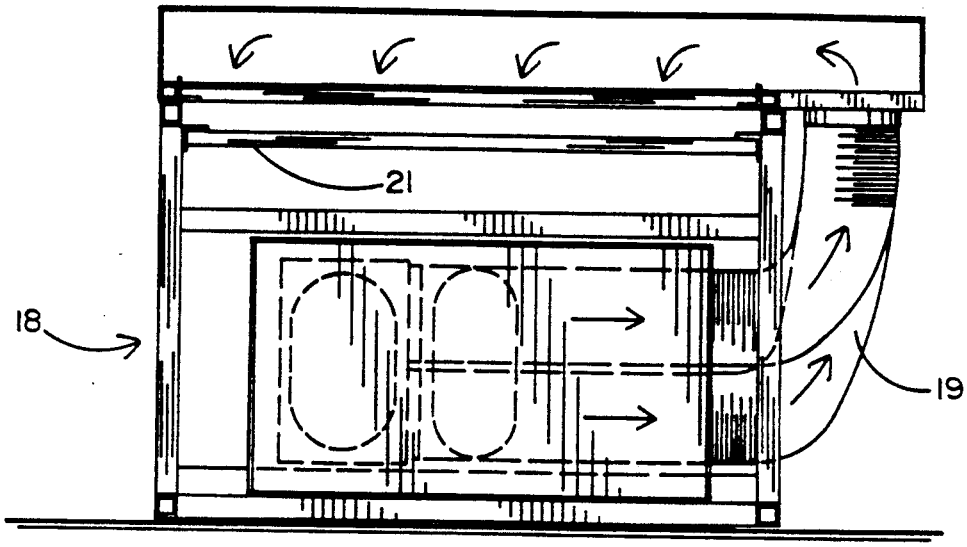
FIG. 3 is a sectional view of optional air conditioning cooler of the present invention taken along lines 3—3 of FIG. 2.

The optional air conditioning cooler 18, shown in FIGS. 1 and 2, is shown in more detail in FIG. 3. As shown therein, the air conditioner unit which supplies 23,600 British Thermal Units of air conditioning power, feeds the conditioned air through an air supply hose 19 and into a plurality of extruded air knives 21, similar to those used in the hot air dryer 12. Although the air conditioning cooler 18 is an optional portion of the preferred embodiment shown herein and should not be deemed to be limiting of the present invention, it is interesting to note that it adds only four additional feet of linear floor space requirement to the overall length of the system.

Figure 5:
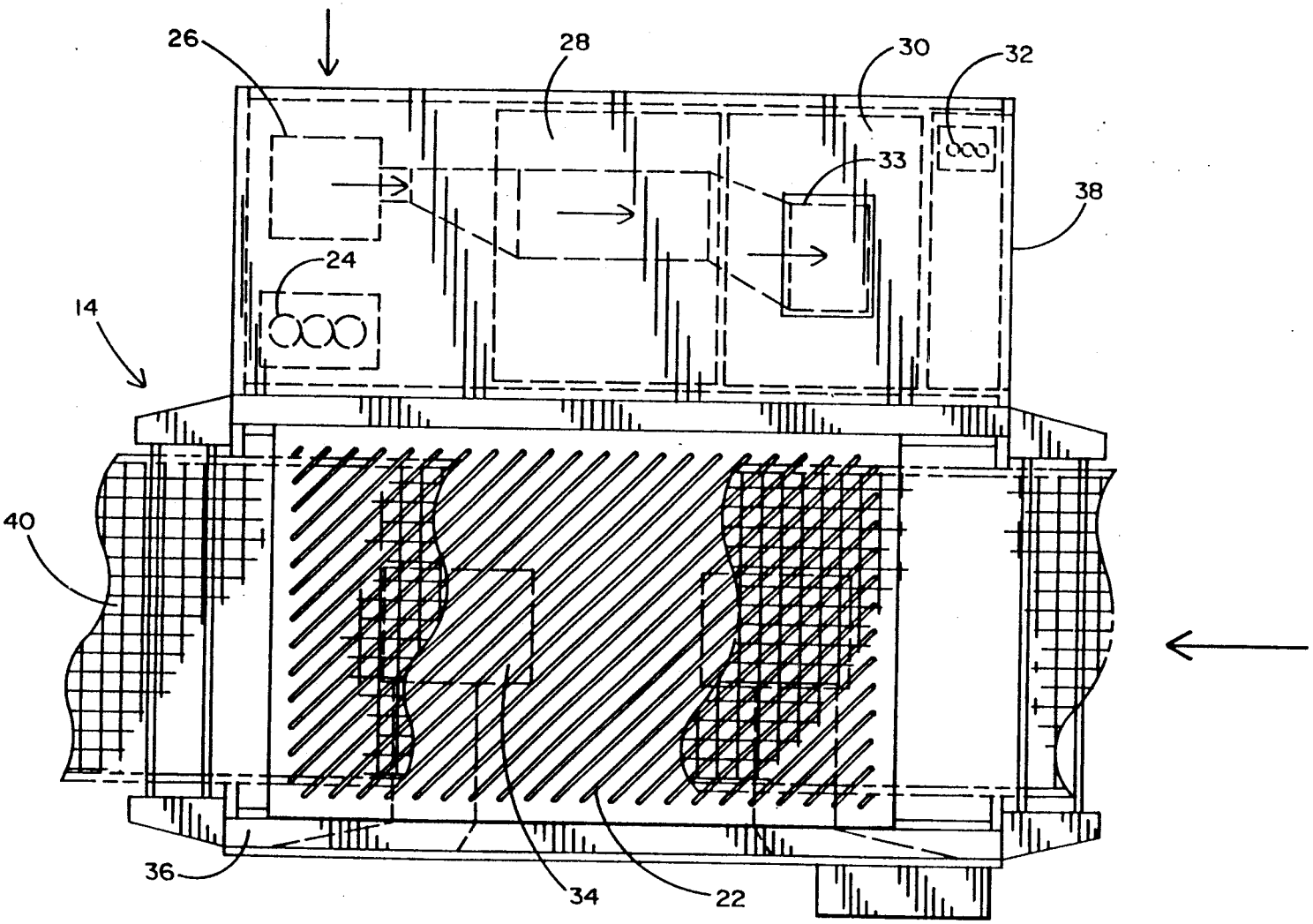
FIG. 5 is a top view of the radio frequency dryer portion of the present invention.
Figure 6:
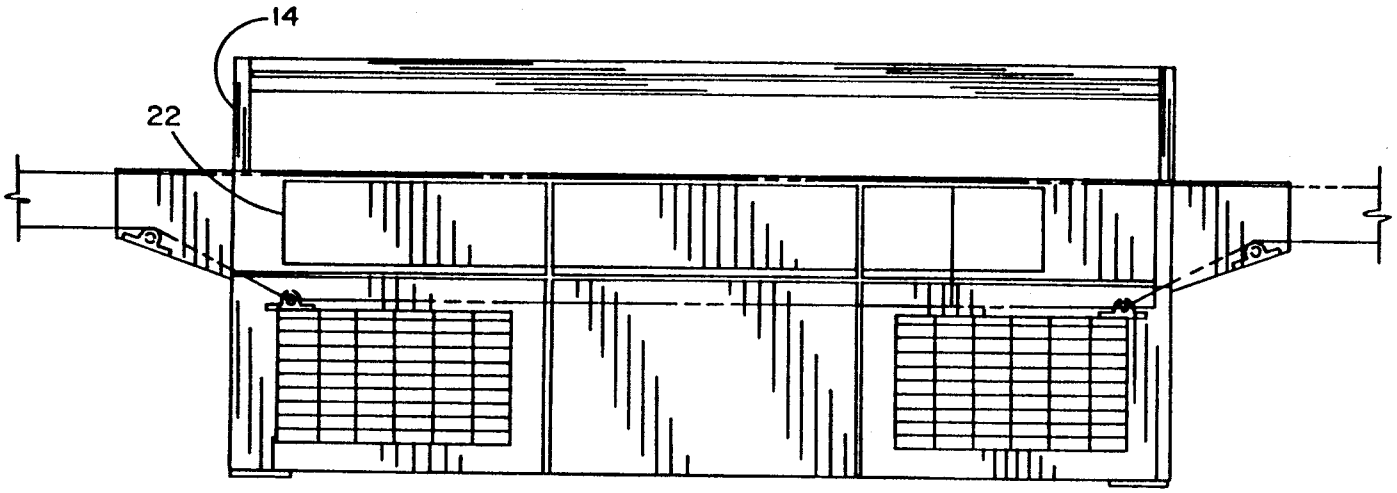
FIG. 6 is a side view of the radio frequency dryer.
Figure 7:
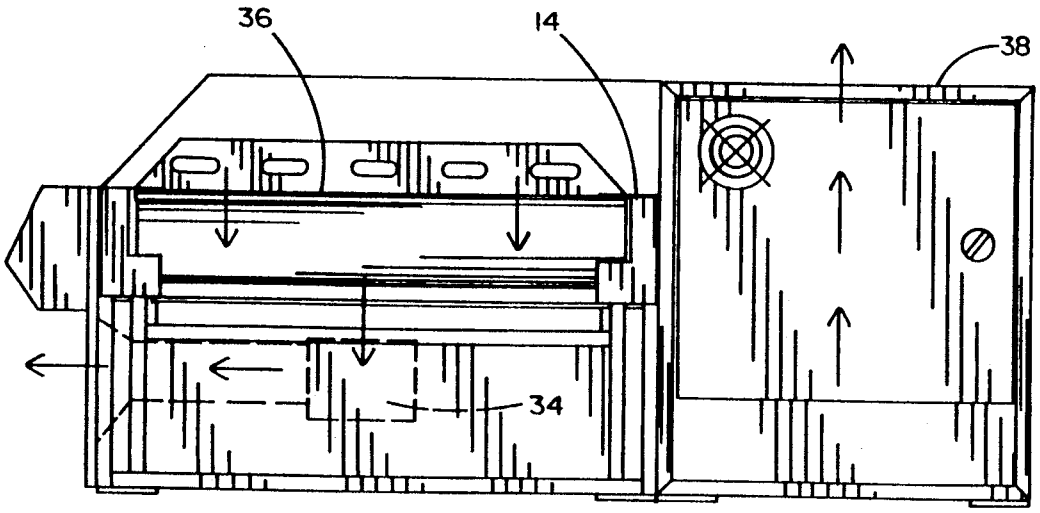
FIG. 7 is an end view of the radio frequency dryer of the present invention.

A more detailed description of the radio frequency dryer of the present invention will now be provided in conjunction with FIGS. 5–7. As seen best in FIG. 5, the radio frequency dryer 14 is provided with a plurality of grid elements 22, which are positioned at a diagonal of 45 degrees relative to the direction of conveyer belt travel. The RF dryer is provided with a high temperature transformer 24, a high pressure blower 26, a filtering unit 28, a radio frequency cavity 30 and a filament transformer 32, which is used to excite the filament in a high power RF oscillator 33, the output of which is connected to the plurality of grid elements 22. In the preferred embodiment of the invention, the power output of the radio frequency dryer is at least 12 kilowatts at an operating frequency of 27.12 MHz. The input power is 22 kilowatts which is provided by a 208 three-phase voltage source (not shown). The grid elements occupy 6½ feet in linear floor space, while the overall length of the RF dryer, including the conveyer belt input and output is about 8 feet. An exhaust blower 34 is provided beneath the grid elements 22 in order to cool the grid elements. In the preferred embodiment of the invention disclosed herein, the radio frequency dryer 14 has a conveyer belt portion 36 that is approximately 59 inches wide and a radio frequency power generation portion 38 which is approximately 39 inches wide. Although the precise operating frequency and power output of the radio frequency dryer may be varied from those specific values disclosed herein, it has been found that a model RF 100 radio frequency dryer manufactured by Siasprint Group of Milan, Italy, is especially suitable for the purposes herein described, without major revision. Furthermore, the aforementioned model RF 100 radio frequency dryer is provided with a teflon conveyer belt material 40 which permits the unimpeded passage of the radio frequency energy to the coating or ink being cured thereby, without any significant attenuation therebetween.

It will now be understood that what has been disclosed herein, comprises an improved drying apparatus for screen process printing and coating, using water-based inks and coatings, whereby a novel combination of a forced hot air dryer and a radio frequency dryer is provided. The principal advantages of the present invention as compared to the prior art reside in the significant savings in floor space requirements and power requirements for high production (i.e., 2,000–3,000 impressions per hour) screen process printing and coating operations which have heretofore utilized a 40 foot length hot air drying apparatus which suffers from a number of disadvantages as previously described. The RF dryer and hot air dryer portions of the present invention are serially arranged on a common conveyer belt apparatus and may be combined with an optional air conditioning cooler which is positioned on the output side of the radio frequency dryer for cooling the cured ink or coating material as it exits from the radio frequency dryer. The radio frequency dryer portion of the preferred embodiment of the present invention, operates at about 27 MHz. generating at least 12 kilowatts of radio frequency output power on an input power of 22 kilowatts maximum. The hot air dryer used with the present invention, because of the significant amount of drying induced by the radio frequency dryer thereof, may be substantially smaller and operate at a substantially lower temperature than the conventional hot air dryer used in the prior art and which provides the entire curing effect of such prior art systems. The reduced size and temperature requirements of the hot air dryer portion of the present invention requires only about 18 kilowatts of input power, thereby reducing the overall power requirements to about 40 kilowatts as compared to 100 to 120 kilowatts for a 40 foot hot air dryer of the prior art. Furthermore, a hot air dryer of the prior art, requires at least 40 feet of linear floor space, as compared to about 15 feet of linear floor space for the novel combination herein disclosed. There is thus, about a 60% reduction in floor space and about an equal reduction in the percentage of input power required for fully curing water-based inks and coatings used in screen process printing at high production rates (i.e., 2,000–3,000 impressions per hour). The present invention thus provides a significant and highly advantageous improvement over the prior art, both in floor space requirement and power requirement, while permitting 100% curing and thus high volume stacking of the resultant impressions. An optional air conditioning cooler is also provided, however, because of the more efficient heating effects of the radio frequency dryer portion of the present invention in curing the coatings and inks without significantly heating the underlying material, such air conditioning cooling may be provided in the present invention in a more efficient manner, as compared to the requirements for cooling in the prior art system.

Those having skill in the art to which the present invention pertains, will now as a result of the applicant's teaching herein, perceive various modifications and additions which may be made to the invention. By way of example, the specific parameters for the radio frequency dryer, as well as for the hot air dryer of the present invention, may be altered without significantly deviating from the teachings of the invention disclosed herein and while still deriving the specific advantages described herein. For example, the operating frequency of the radio frequency dryer may be readily altered by using a different oscillator circuit therein and the geometrical configuration of the grid elements supplied in juxtaposition to the conveyer belt of the radio frequency dryer may be altered without significantly affecting the operating efficiency of the system disclosed herein. Furthermore, the present invention may also be employed advantageously in lower volume screen process drying applications. Accordingly, all such modifications and additions are deemed to be within the scope of the invention which is to be limited only by the claims appended hereto and their equivalents.

I claim:

1. An improved drying apparatus for use in drying water-based inks and coatings in screen process printing and coating applications; the improvement comprising:

a forced heated air dryer; and a radio frequency (RF) power dryer;

said air dryer and said RF power dryer being serially arranged along a common path for receiving a sequential plurality of printed or coated materials from a screen process apparatus;

said RF power dryer comprising a conveyer belt for transporting said materials and a plurality of grid elements arranged in a selected array adjacent said conveyer belt for generating RF energy to cure said inks and coatings.

2. The improvement recited in claim 1 wherein said air dryer comprises a source of high velocity air; a heater for raising the temperature of said high velocity air; a conveyer belt for transporting said materials and means for directing high temperature, high velocity air onto said materials for initiating the curing of said inks and coatings.

3. The improvement recited in claim 1 wherein said drying apparatus is capable of drying at least 2,000 impressions per hour and occupies less than 15 linear feet of floor space.

4. The improvement recited in claim 1 wherein said drying apparatus is capable of drying at least 2,000 impressions per hour and requires less than 50,000 watts of energy.

5. The improvement recited in claim 1 further comprising:

a cooling device arranged along said common path for receiving said materials from said RF dryer for cooling prior to stocking said materials.

6. The improvement recited in claim 1 wherein said RF dryer generates at least 12,000 watts of RF power at about 27 MHz.

* * * * *